US011649685B2

(12) United States Patent
Porter

(10) Patent No.: US 11,649,685 B2
(45) **Date of Patent: *May 16, 2023**

(54) MECHANICAL SHUTTLE PIPE GRIPPER

(71) Applicant: The Charles Machine Works, Inc., Perry, OK (US)

(72) Inventor: Rick G. Porter, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/508,397

(22) Filed: Oct. 22, 2021

(65) Prior Publication Data

US 2022/0042380 A1 Feb. 10, 2022

Related U.S. Application Data

(63) Continuation of application No. 16/408,691, filed on May 10, 2019, now Pat. No. 11,156,039.

(60) Provisional application No. 62/670,964, filed on May 14, 2018.

(51) Int. Cl.
*E21B 19/15* (2006.01)

(52) U.S. Cl.
CPC ..... *E21B 19/15* (2013.01)

(58) Field of Classification Search
CPC ..... E21B 19/15; E21B 7/046; E21B 7/02
See application file for complete search history.

(56) References Cited

U.S. PATENT DOCUMENTS 6,179,065 B1 1/2001 Payne et al.
6,332,502 B1 12/2001 Mills et al.
6,360,830 B1 3/2002 Price
6,533,046 B2 3/2003 Mills et al.
7,011,166 B2 * 3/2006 Koch ..... H02K 37/125 175/85
7,018,164 B2 3/2006 Anthis et al.
7,240,742 B2 7/2007 Sewell et al.
7,467,670 B2 12/2008 Hartke et al.
(Continued)

FOREIGN PATENT DOCUMENTS

WO 2007041822 A1 4/2007

OTHER PUBLICATIONS

Korean Intellectual Property Office, "PCT International Search Report" dated Nov. 17, 2015, 3 pages, Republic of Korea.
(Continued)

*Primary Examiner* — Michael R Wills, III

(74) *Attorney, Agent, or Firm* — Tomlinson McKinstry, P.C.

(57) ABSTRACT

A pipe shuttle for moving a pipe segment from an operating position to a pipe box. The pipe shuttle has a pair of gripper arms flanking a cradle. The cradle has a spring-loaded pad that has a concave surface for holding a pipe segment. As the pipe shuttle moves from underneath a pipe box to near a cradle, rollers are positioned to engage a guide plate. When the shuttle is underneath the pipe box, the rollers engage the guide plate to keep the cradle open. When moved towards an operating position, the rollers no longer engage the guide plate and cause grippers to close on the pipe segment. The spring-loaded pad allows the pipe shuttle to be moved relative to the pipe segment when the pipe segment is in its operating position.

20 Claims, 14 Drawing Sheets

(56) References Cited

U.S. PATENT DOCUMENTS

| | | | |
|---|---|---|---|
| 7,544,036 | B1 | 6/2009 | Randall et al. |
| 7,600,584 | B2 | 10/2009 | Sewell et al. |
| 7,694,751 | B2 | 4/2010 | Hartke |
| 9,127,518 | B1 | 9/2015 | Sewell |
| 2001/0022238 | A1 | 9/2001 | Houwelingen et al. |
| 2002/0153169 | A1 | 10/2002 | Sewell |
| 2003/0196791 | A1 | 10/2003 | Dunn et al. |
| 2005/0103526 | A1 | 5/2005 | Ayling |
| 2007/0031215 | A1 | 2/2007 | Belik |
| 2007/0119623 | A1 | 5/2007 | Sewell et al. |
| 2007/0240903 | A1 | 10/2007 | Alft et al. |
| 2009/0095526 | A1 | 4/2009 | Lane et al. |
| 2013/0240269 | A1 | 9/2013 | Novelo et al. |
| 2017/0159379 | A1 | 6/2017 | Metcalf et al. |
| 2017/0370149 | A1 | 12/2017 | Sevits et al. |
| 2019/0234158 | A1* | 8/2019 | Porter ..... E21B 19/20 |

OTHER PUBLICATIONS

The Charles Machine Works, Inc., "Ditch Witch Shuttle Stop—Ends with S/N: DWPJT40XPH000015", pages from company manual, undated, 3 pages, Perry, Oklahoma.
The Charles Machine Works, Inc., "Pipe Loader Shuttle", pages from company manual, undated, 2 pages, Perry, Oklahoma.
The Charles Machine Works, Inc., "Pipe Shuttle", pages from company manual, undated, 4 pages, Perry, Oklahoma.
The Charles Machine Works, Inc., "Shuttle Drive", pages from company manual, undated, 3 pages, Perry, Oklahoma.

* cited by examiner

MECHANICAL SHUTTLE PIPE GRIPPER

SUMMARY

The present invention is directed to a pipe shuttle. The pipe shuttle comprises a linear shuttle track, a shuttle body, a shuttle drive system, a gripper, and a cam-follower arrangement. The shuttle body is supported by the shuttle track and constrained to move therealong. The drive system is configured to power movement of the shuttle body. The gripper is rotatably supported by the shuttle body and conformable to a pipe. The cam-follower arrangement is capable of causing rotation of the gripper in response to linear motion of the shuttle body.

The present invention is also directed to a drilling machine. The drilling machine comprises a machine frame, a pipe box, a carriage, and a pipe shuttle. The pipe box is supported on the machine frame and contains a plurality of pipe sections. The carriage is movable along the machine frame in a first direction and connectable to each of the plurality of pipe sections. The pipe shuttle comprises a guide plate, a support frame, and a gripper. The guide plate is fixed in position relative to the machine frame. The support frame is supported by the guide plate and movable relative thereto in a second direction. The gripper is disposed on the support frame. The gripper is engageable with the guide plate. The gripper is movable between an open position and a closed position, and configured to conform to a pipe section held by the support frame when in the closed position. The gripper is maintained in the open position when the gripper engages the guide plate.

DETAILED DESCRIPTION

Many utility pipelines are installed underground by boring a borehole in a generally-horizontal direction rather than by digging a trench. This type of construction is typically referred to as "horizontal boring" or "horizontal directional drilling" ("HDD"). A horizontal borehole is created by using a drilling machine to drive rotation of a drill bit attached to a drill string. The drill string is made of up of a plurality of pipe sections connected together. The pipe sections are stacked in columns within a pipe box attached to the drilling machine. A carriage included within the drilling machine connects the pipe sections together and pushes or pulls the drill string through the ground surface.

In operation, a pipe handling assembly uses a pair of shuttle arms to transport each pipe section between the pipe box and the carriage. The shuttle arms are stopped beneath each column using a pipe column selection assembly.

Shuttle arms often comprise an open socket or a catchment for supporting a pipe section as it is moved from beneath a pipe box to the carriage. Securing the pipe section so that sudden stops or jolts do not dislodge them from the shuttle arms is advantageous. In addition, the precise location of a pipe section in the shuttle arm enables faster and better pairing of the pipe section to the carriage and the drill string.

Figure 1:
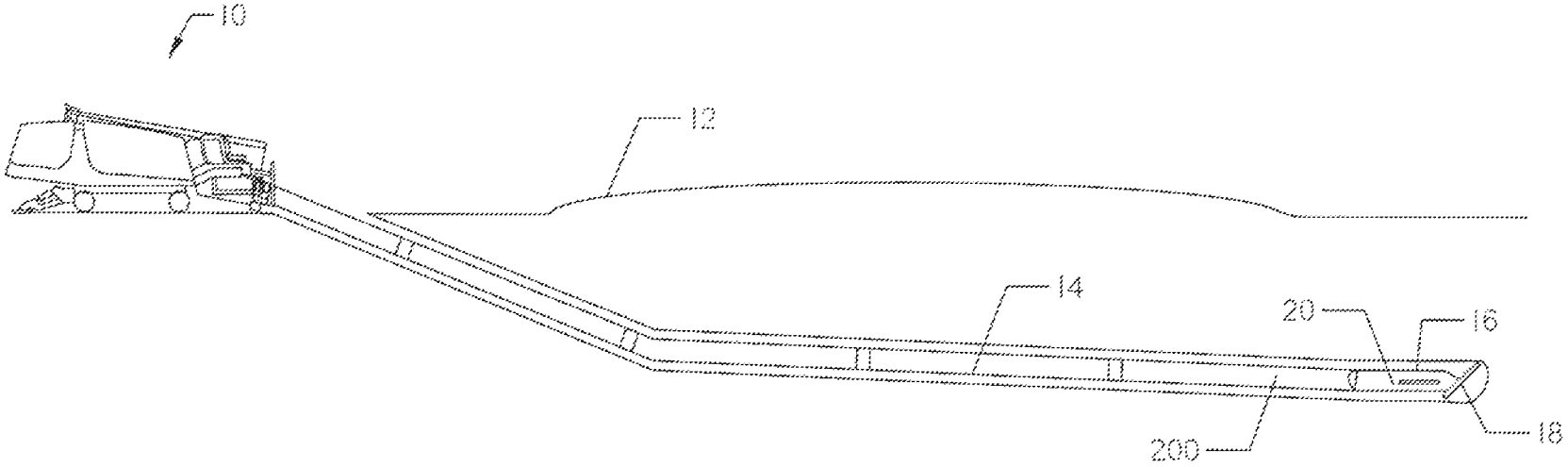
FIG. 1 is an illustration of a horizontal boring operation

With reference now to the figures, FIG. 1 shows a drilling machine 10 sitting on a ground surface 12. Extending from the drilling machine 10 is a drill string 14. The drill string 14 is made up of a plurality of pipe sections 200 attached end to end. The drill string 14 is connected to a downhole tool 16 at its first end and the drilling machine 10 at its second end.

The downhole tool 16 comprises a drill bit 18 and a beacon contained within a beacon housing 20. An above ground operator uses a tracking device (not shown) to confirm the location of the beacon housing 20 underground.

In operation, the drill string 14 is rotated by the drilling machine 10, causing the drill bit 18 to displace underground material and create a borehole. The drilling machine 10 adds pipe sections 200 to the drill string 14 as the downhole tool 16 advances underground.

Figure 2:
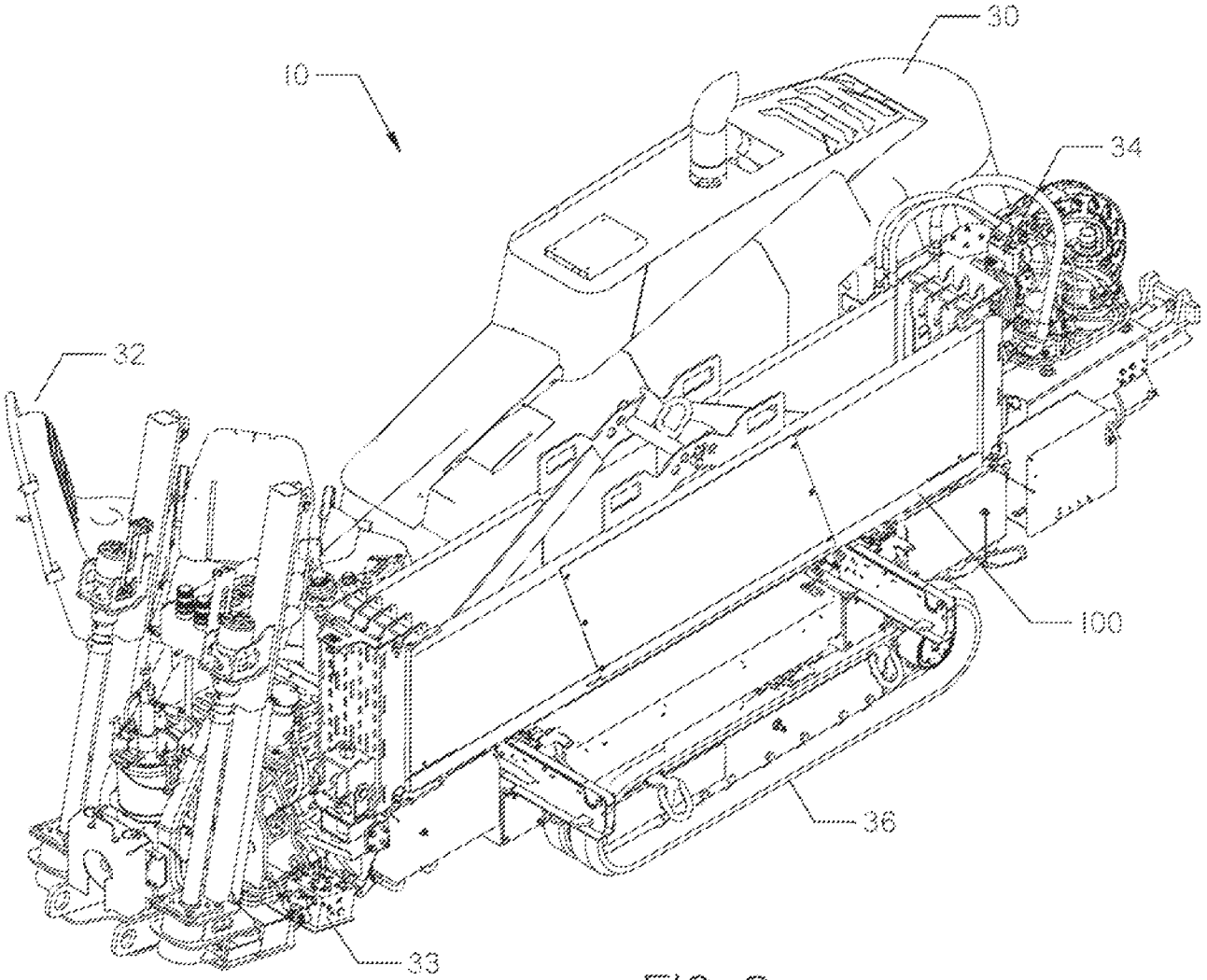
FIG. 2 is a perspective view of a horizontal boring machine of the present invention.

As shown in FIG. 2, the drilling machine 10 comprises an engine housed within an engine cowl 30, an operator station 32, a pipe handling assembly 100, a wrench assembly 33 and a carriage 34. The components of drilling machine 10 are supported on a frame that is in turn supported on a pair of endless tracks 36. The tracks 36 move the machine 10 from location to location.

The carriage 34 connects pipe sections 200 to or removes pipe sections 200 from the drill string 14 (FIG. 1). The wrench assembly 33 provides torque to this connection or removal process, and may hold the drill string 14 while a new pipe section is threaded by the carriage 34. The carriage 34 also moves back and forth along the frame to push and pull the drill string through the ground. The carriage 34 moves along the frame of the drilling machine 10 in a first direction to provide thrust to the drill string 14 and to return to its starting location for connection to a new drill section 200.

The present invention is directed to a pipe handling assembly 100 that provides for reliable transfer of pipe into and out of the carriage 34 using a mechanical cam-follower arrangement rather than hydraulics.

Figure 3:
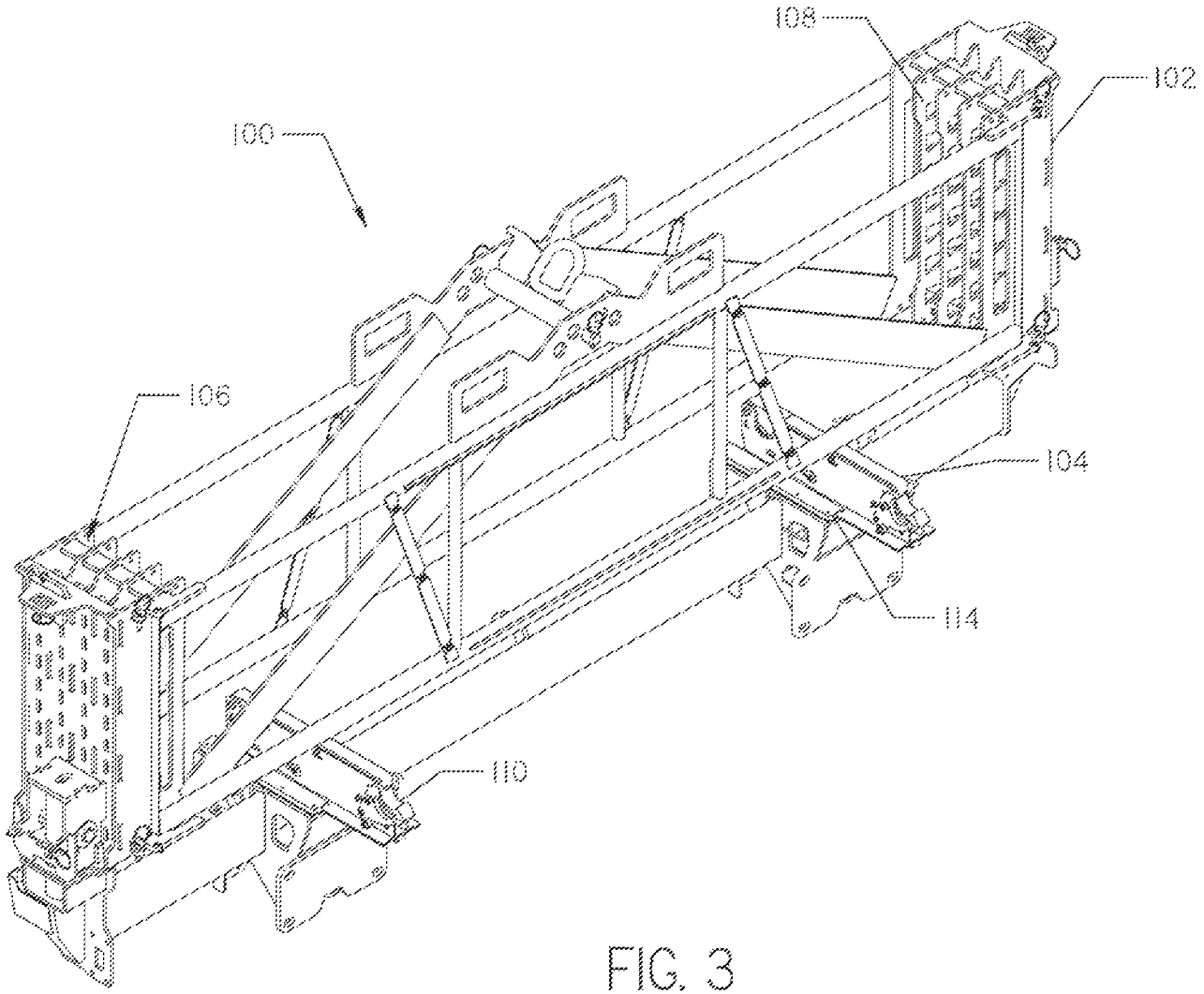
FIG. 3 is a perspective view of a pipe handling assembly removed from the horizontal boring machine of FIG. 2. The shuttle arms are shown in the operating position.
Figure 10:
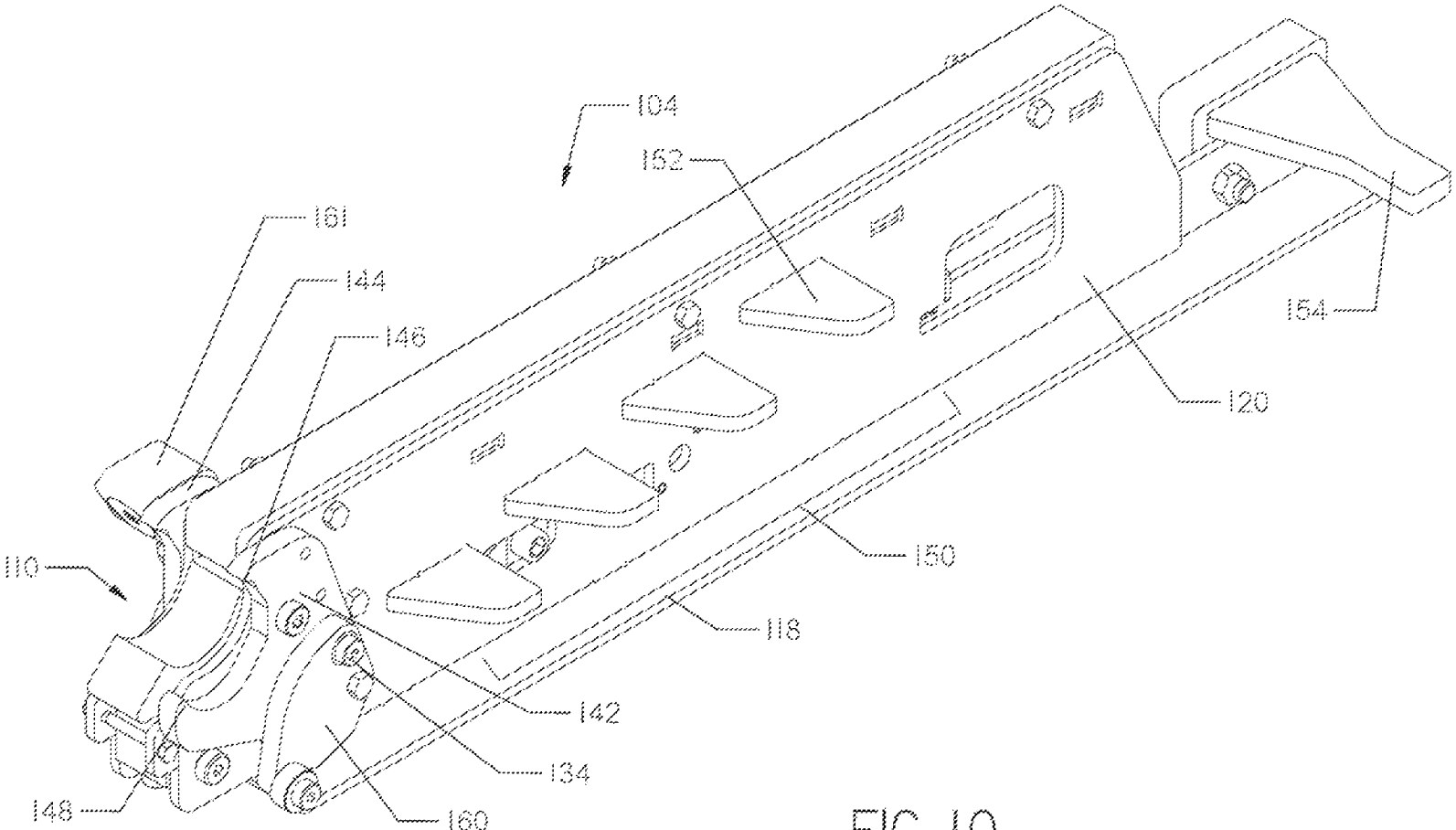
FIG. 10 is a top right perspective view of an embodiment of a shuttle arm.

With reference to FIGS. 2-3, a pipe handling assembly 100 stores the pipe segments 200 and provides a mechanism for moving stored pipe sections in a second direction along the frame of the drilling machine 10 for connection to the drill string 14. The pipe handling assembly 100 comprises a pipe box 102, a pair of shuttle arms 104, and a pipe column stop assembly 150 (FIG. 10). The pipe box 102 contains four columns 106 for storing pipe sections 200. The columns 106 are created by dividers 108 formed at opposite ends inside the pipe box 102. The shuttle arms 104 are positioned such that they are parallel to and spaced apart from one another on the frame underneath the pipe box 102.

In operation, the shuttle arms 104 retrieve pipe sections from each of the columns 106 and deliver the pipe sections to the carriage 34 (FIG. 2) to be added to the drill string 14 (FIG. 1). If a drill string is being removed from the borehole, the shuttle arms 104 will remove pipe sections from the carriage 34 and return the pipe sections to the pipe box 102. The pipe sections are held in a cradle 110 formed at the end of each of the arms 104.

With reference to FIGS. 3-9B, the shuttle arms 104 are moved using a drive system, such as a rack and pinion gear. The rack 112 is secured to a bottom of each of the shuttle arms 104 and has a forward and rearward end. Each rack 112 mates with a corresponding pinion gear (not shown) mounted on the frame via brackets. The rotating pinion gears engage the racks causing the shuttle arms 104 to move back and forth on the frame. Other means for translating the shuttle arms 104 may include a linear actuator like a hydraulic cylinder or jackscrew.

Figure 4:
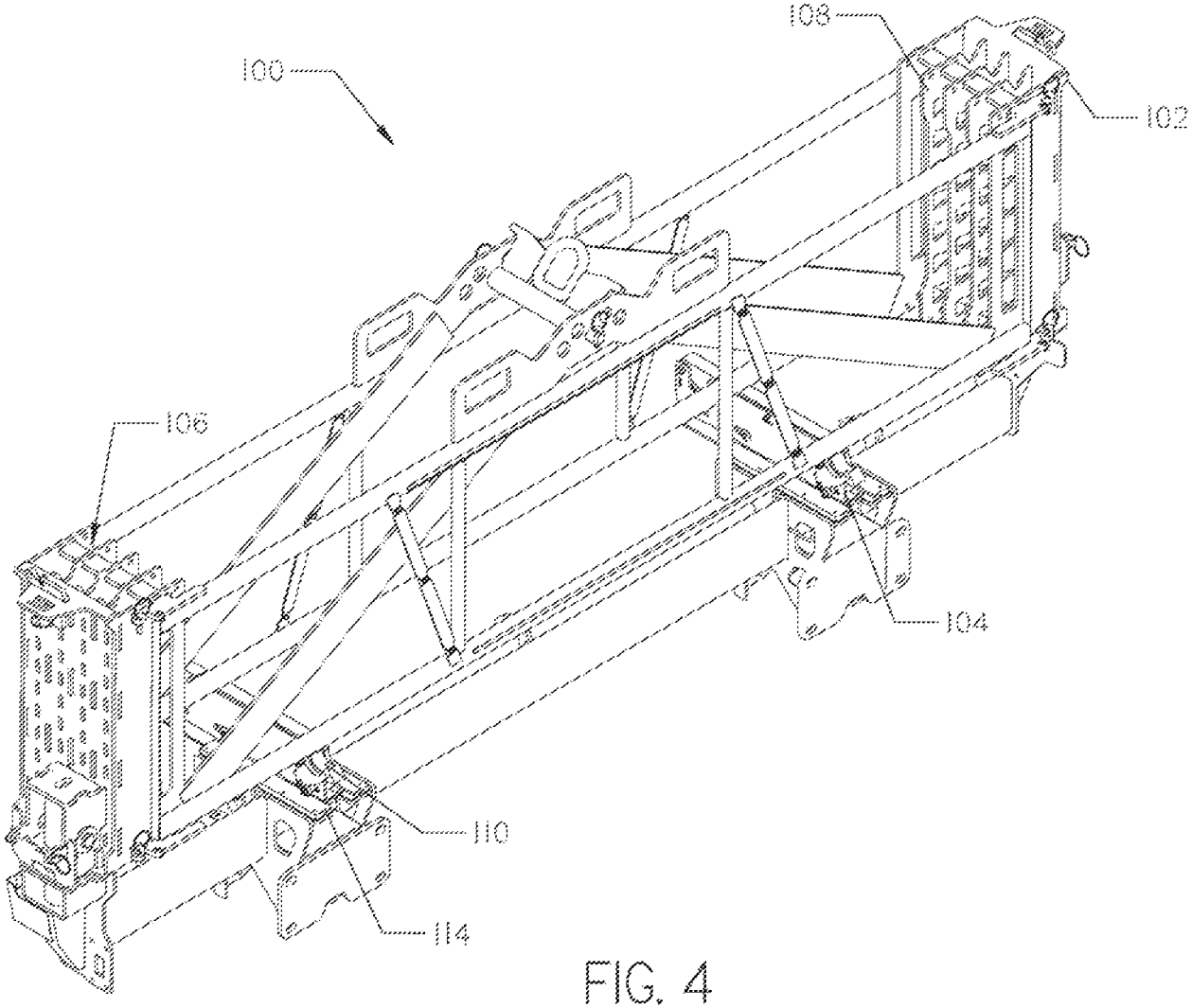
FIG. 4 is a perspective view of the pipe handling assembly of FIG. 3. The shuttle arms are shown under a pipe box column.
Figure 5:
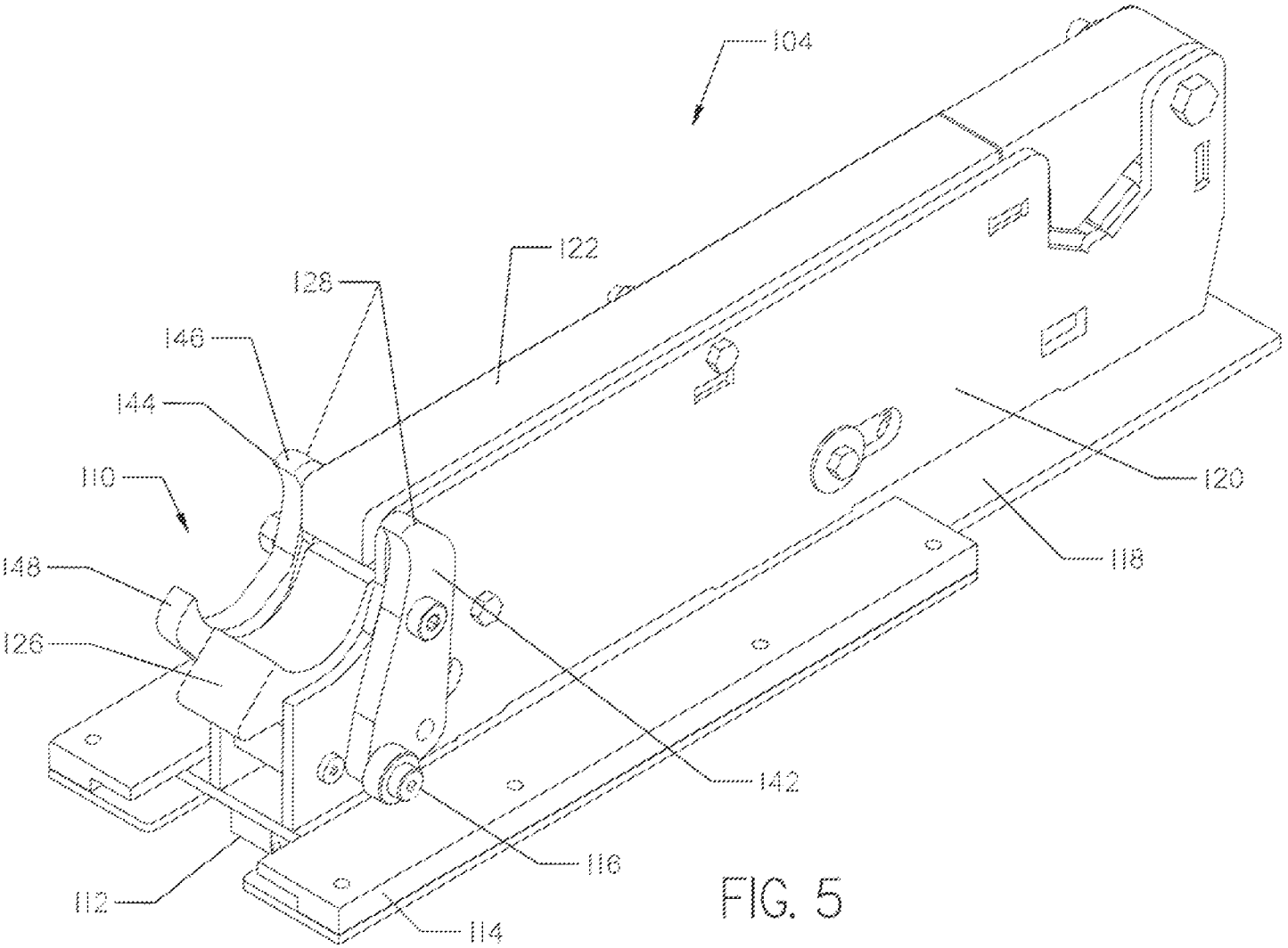
FIG. 5 is a perspective view of a shuttle arm of the pipe handling assembly of FIG. 3. The cradle is shown in the open position.
Figure 6A:
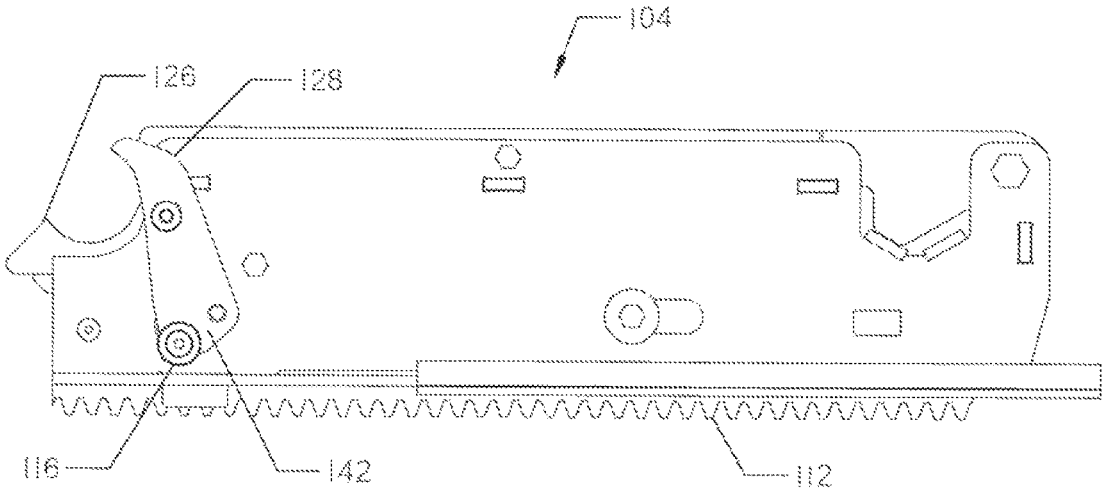
FIG. 6A is a first side view of the shuttle arm of FIG. 5. The cradle is shown in the closed position.
Figure 6B:
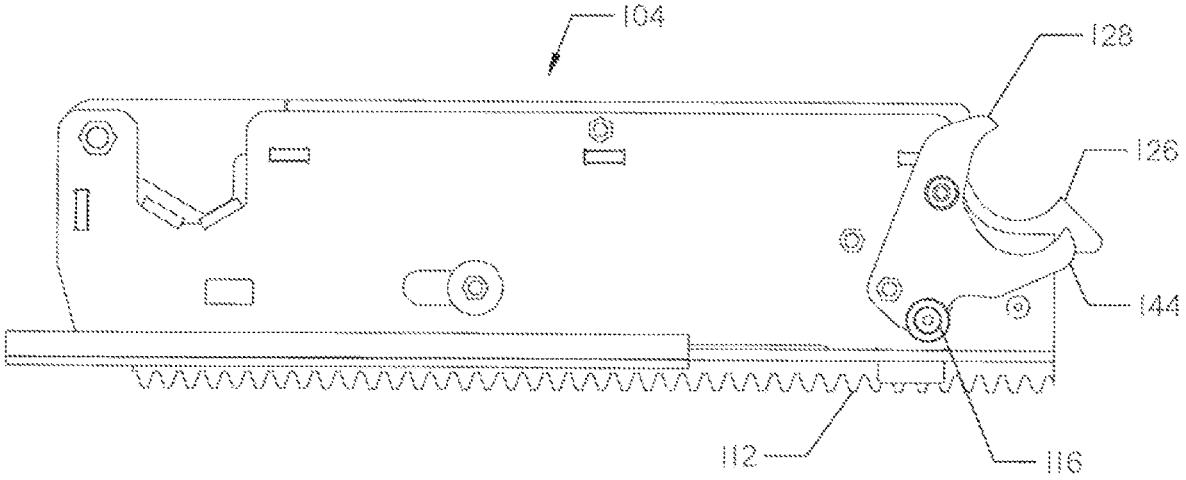
FIG. 6B is a second side view of the shuttle arm of FIG. 5. The cradle is shown in the closed position.
Figure 7A:
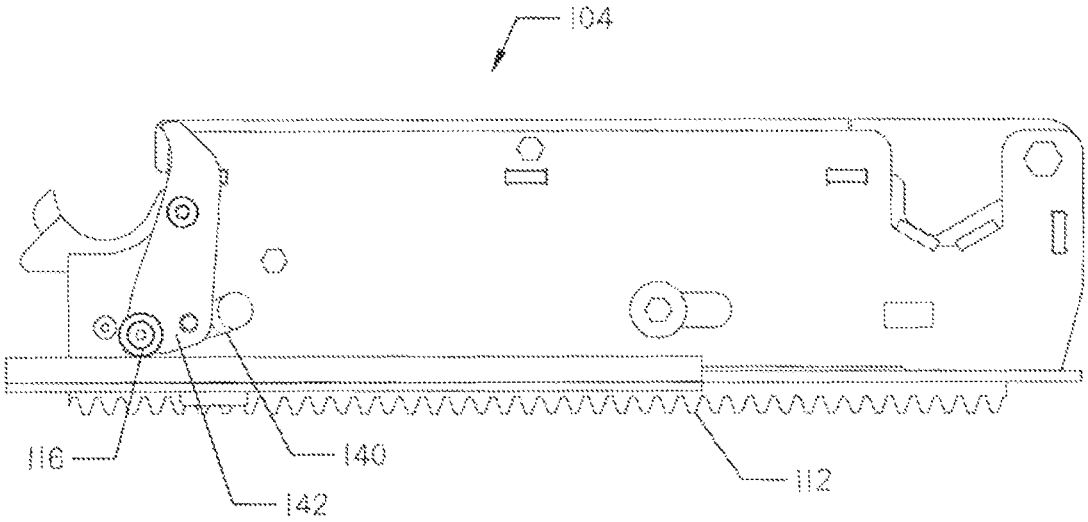
FIG. 7A is a first side view of the shuttle arm of FIG. 5. The cradle is shown in the open position.
Figure 7B:
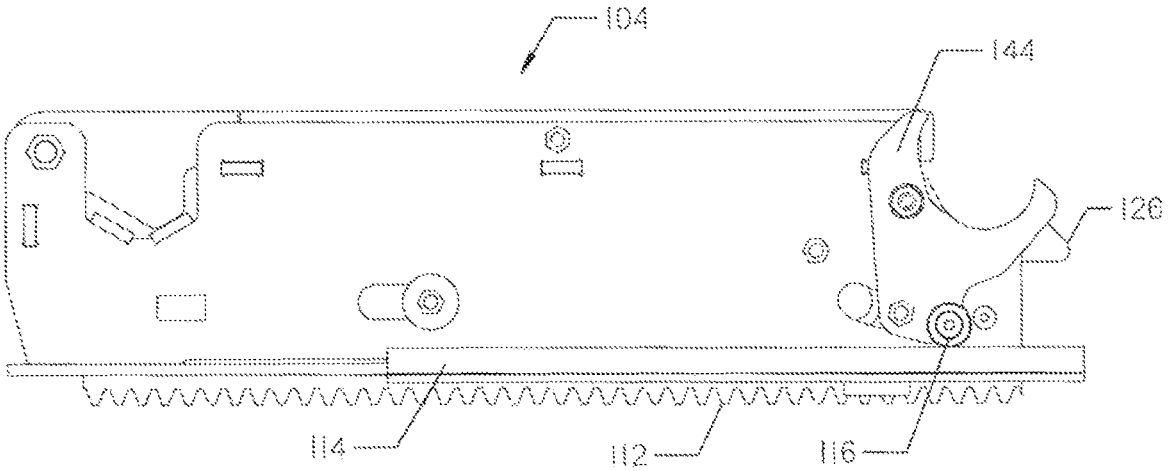
FIG. 7B is a second side view of the shuttle arm of FIG. 5. The cradle is shown in the open position.

The shuttle arms 104 move between guides 114 mounted to the frame and brackets. The shuttle arm 104 is mounted between guides 114 in which it may move longitudinally via the rack 112 and pinion. The shuttle arms 104 in FIG. 3 are shown in the operating position. In the operating position the cradle 110 is closed, such that a pipe section 200 is secured inside. As the shuttle arms 104 move away from the carriage 34 and towards the pipe box 102 the cradle 110 is opened through a pair of rollers 116 which engage the guide 114. The rollers 116 allow the cradle 110 to open and the shuttle arm 104 is positioned underneath one of four columns 106 (FIG. 4). The shuttle arms 104 may then either return or retrieve a pipe section from the column 106 while the cradle 110 is in the open position.

The shuttle arm 104 comprises the cradle no, a bottom plate 118, a pair of side plates 120, and the rack 112 and a top plate 122. The bottom plate 118, side plates 120 and top plate 122 generally form a support frame for supporting the cradle and allowing the movement relative to the drilling machine. The bottom plate 118 is situated within a slot in the guide 114 (FIG. 14) and allows for single-axis movement of the shuttle arm 104 in the second direction along this linear track. Preferably, the second direction is transverse to the first direction.

The cradle no comprises a pad 126, a pair of grippers 128, the rollers 116, a compression spring 130, and an extension spring 132. The extension spring 132 (FIGS. 8A-8B) biases the grippers 128 in a closed position by maintaining pressure on a bushing 134 that is attached to the lower end of each of the grippers 128. The tension on the extension spring 132 may be adjusted with a tensioner 138. Tension is primarily adjusted during assembly. As shown, the tensioner 138 is a screw for adjusting the distance between the ends of the extension spring 132. While the grippers 128 are in the closed position, the cradle no is closed such that pipe sections cannot be added or removed from the pipe box.

Figure 8A:
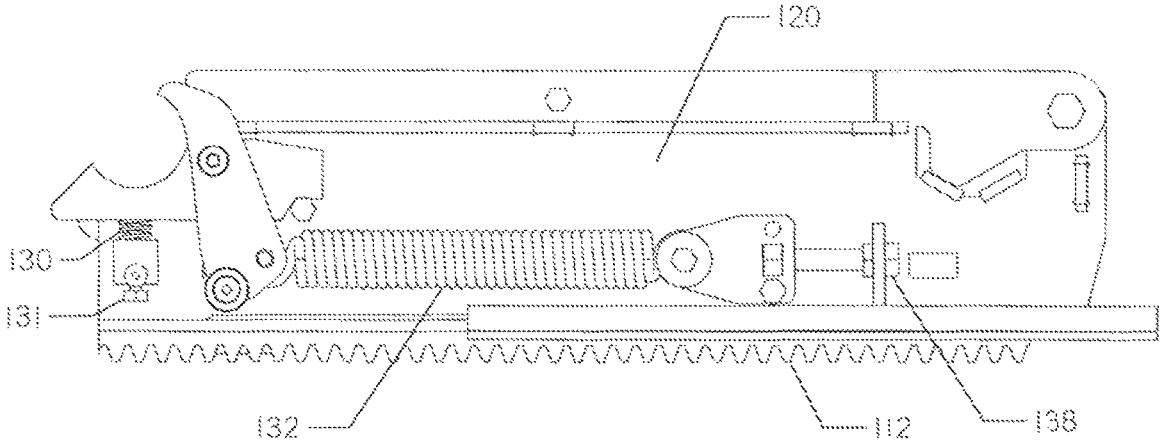
FIG. 8A is the first side view of the shuttle arm of FIG. 5 with the side plate removed.
Figure 8B:
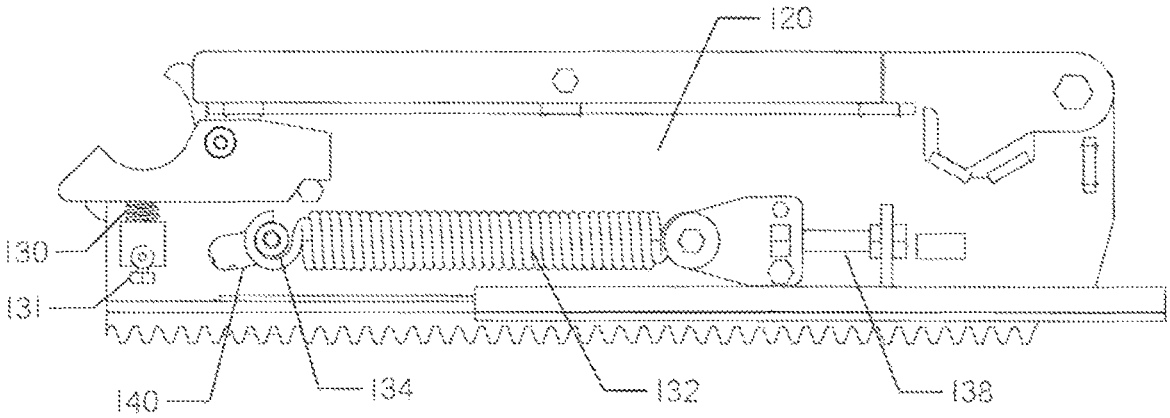
FIG. 8B is a cross-sectional view of the first side view of the shuttle arm of FIG. 5.
Figure 9A:
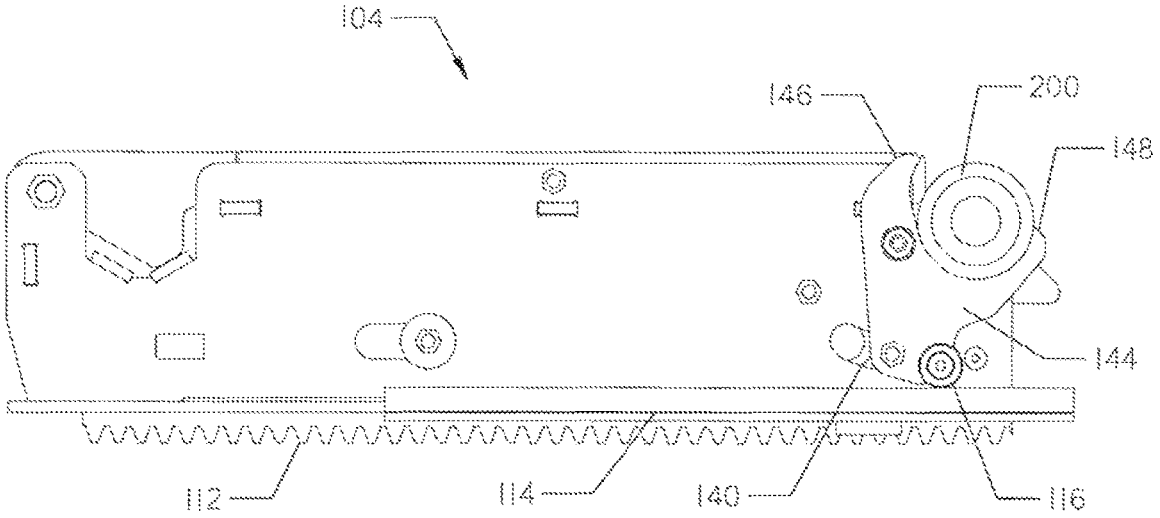
FIG. 9A is the second side view of the shuttle arm of FIG. 5 with a pipe held in the cradle. The cradle is shown in the open position.
Figure 9B:
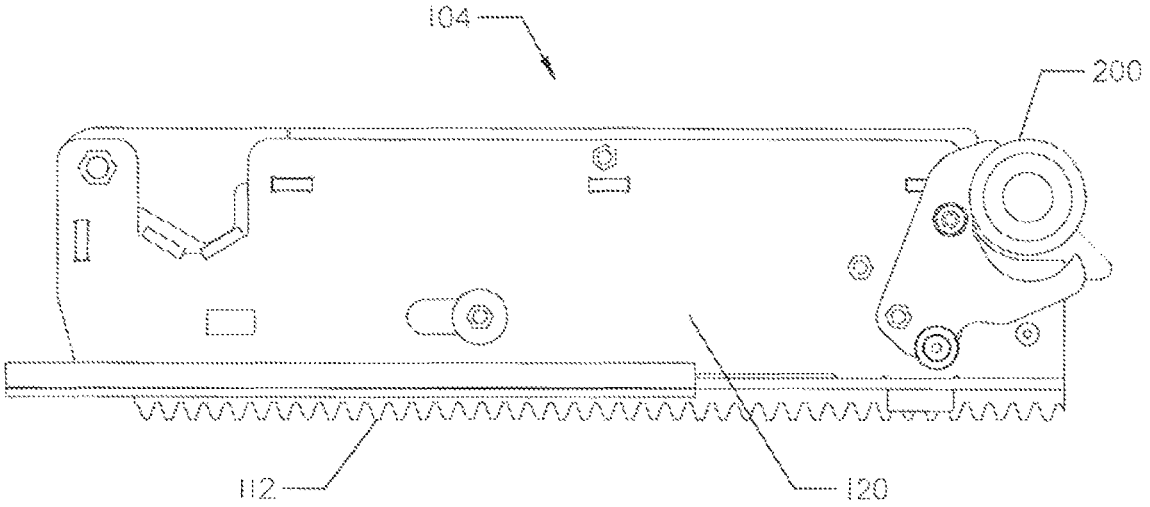
FIG. 9B is the second side view of the shuttle arm of FIG. 5 with a pipe held in the cradle. The cradle is shown in the closed position.

The bushing 134 is situated between a first set of slots 140 in the side plates 120. (FIGS. 8A-8B). The grippers 128 rotate between an open and closed position as the bushing 134 slides back and forth within the first set of slots 140 in a cam-follower arrangement. However, when the shuttle arm 104 is in an operating position such that a pipe segment 200 held within would be near the carriage 34, the cam-follower does not function. As a result, when the shuttle arm 104 is in the operating position the extension spring 132 holds the grippers 128 in the closed position. As the shuttle arm 104 moves under the pipe box 102 and the rollers 116 engage the guide 114, the extension spring 132 expands and the grippers 128 are pushed to the open position (FIGS. 7A-7B), opening the cradle 110.

After the shuttle arm 104 returns or retrieves a pipe section 200 (FIGS. 9A-9B) from the pipe box 102 the shuttle arm is reversed and moves back towards the operating position. When the rollers 116 disengage the guide 114 the extension spring 132 retracts and the grippers 128 move to the closed position. The cam-follower arrangement and extension spring 132 ensures that movement from the open position to the closed position only occurs when the shuttle arm 104 moves from the pipe box to the operating position. Likewise, movement from the closed position to the open position occurs only when the shuttle arm 104 is moved in the opposite linear direction, back towards the pipe box 102.

In the embodiment of FIGS. 5-9B, the grippers 128 include a first gripper 142 and a second gripper 144 situated on either side of the pad 126. Both grippers 142, 144 comprise an upper end 146 to hold the pipe between the gripper and the pad 126 when the gripper 128 is in the closed position. The second gripper 144, as shown, has a lower end 148 that serves as a retainer for a pipe section being returned or retrieved from the pipe box 102 while the cradle no is in the open position (FIG. 9A). In an alternative embodiment, both grippers 128 could comprise an upper 146 and lower end 148. Each gripper 128 is conformable to the pipe, and is in opposed relationship to the concave surface of the pad 126.

When the cradle 110 is in the closed position with a pipe section 200 held by the grippers 128, force is applied to the pipe section 200 by the pad 126. The pad 126 is attached to the side plates 120. The front side of the gripper pad 126 sits on the compression spring 130. The compression spring 130 exerts an upward force on the pad 126 and the pipe section 200 (FIGS. 8A-9B). The amount of tension on the compression spring 130 can be adjusted by turning the compression spring bolt 131.

When the shuttle arm 104 is in the operating position, the carriage 34 will connect a pipe section 200 to the drill string 14 or remove a pipe section from the drill string. As the carriage 34 connects a pipe section 200 to the drill string 14 the shuttle arm 104 will move away from the operating position. At this point, the pipe segment 200 is held fast by its connection to the drill string 14 and the carriage 34.

Figure 12A:
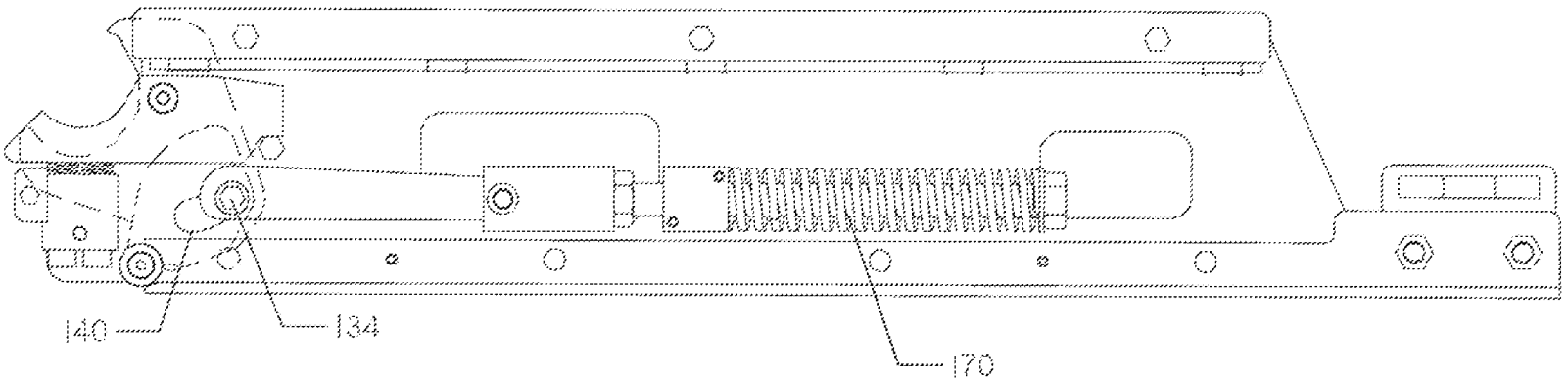
FIG. 12A is a side view of the shuttle arm of FIG. 10 with the cradle shown in the closed position and the side plate removed.
Figure 13A:
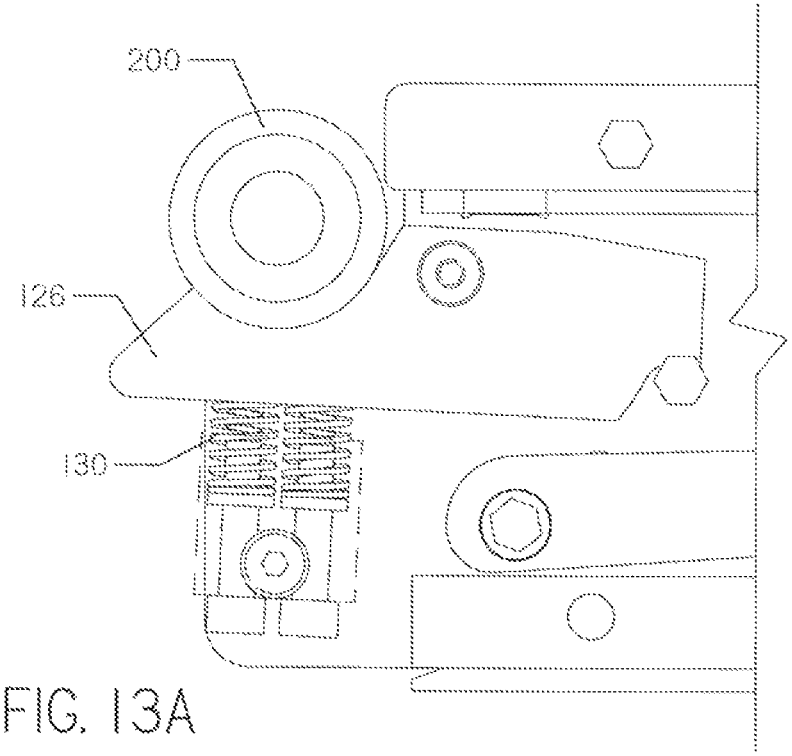
FIG. 13A is a detail side view of a pipe section being held within the cradle, showing the compression spring and spring block in phantom.
Figure 13B:
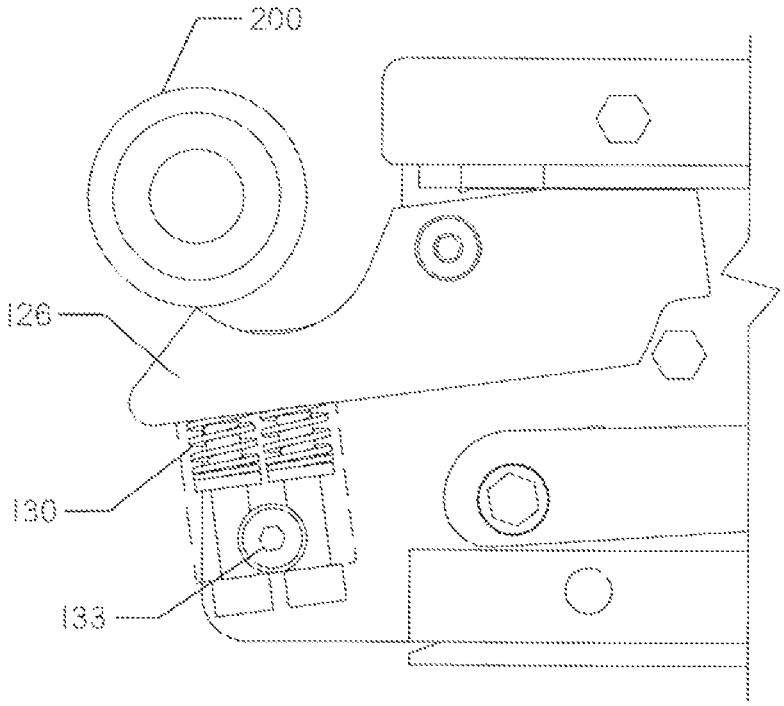
FIG. 13B is the detail view of FIG. 13A with the pipe section causing the compression springs and pad to tilt.
Figure 14:
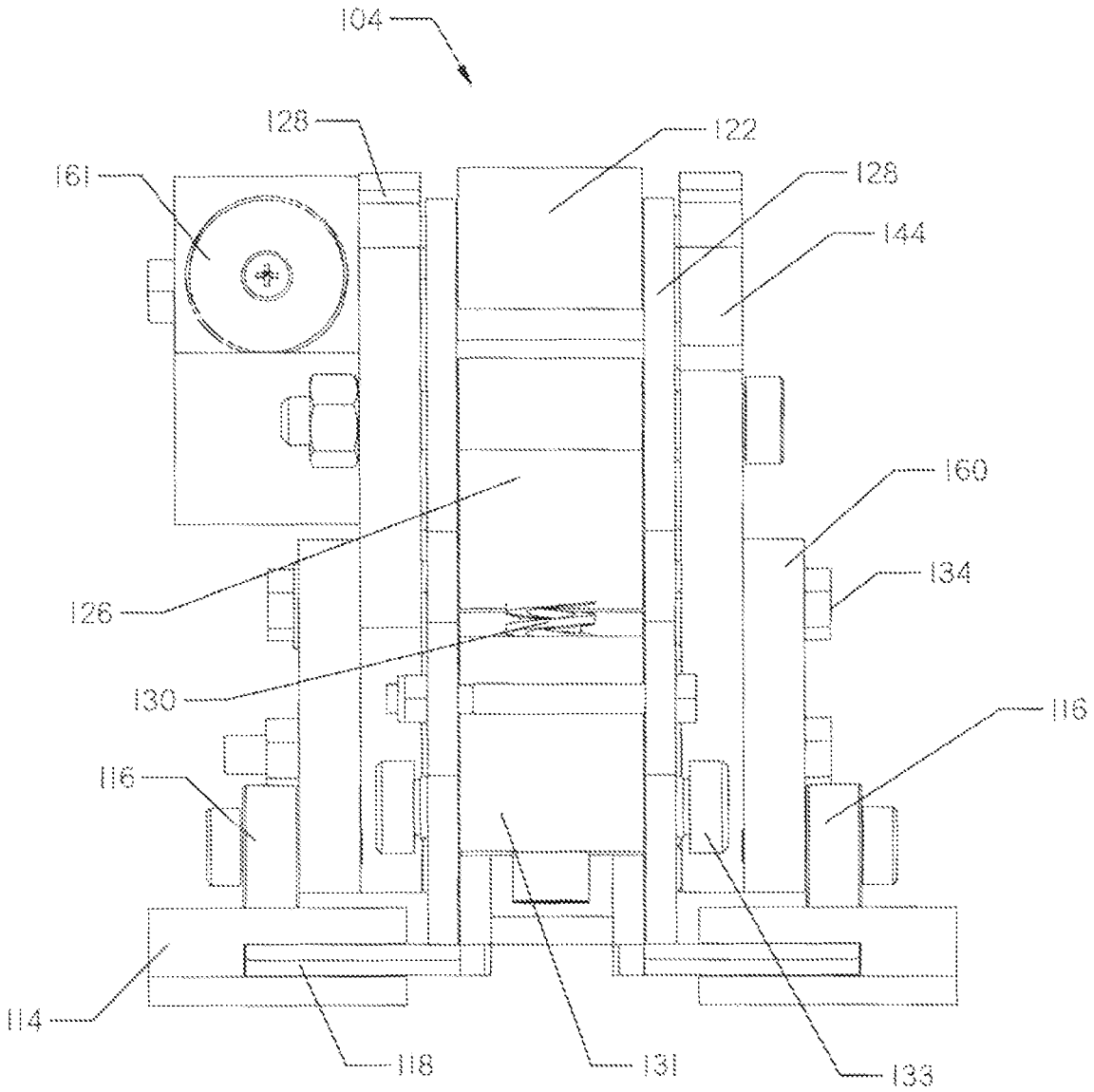
FIG. 14 is a front view of the shuttle arm of FIGS. 10-11.

With reference to FIGS. 13A-14, as the shuttle arm 104 moves away from the operating position, the pipe section 200 will force the pad 126 to press down on the compression spring 130. As shown in FIG. 13B, the pad will move down and around the pipe section 200 enough to allow the shuttle arm 104 to pull away from the pipe section. Likewise, when the shuttle arm 104 is moving towards the carriage 34 to retrieve a pipe section from the carriage, the gripper pad 126 will press down on the compression spring 130 under the force of the pipe section 200 enough to allow the cradle no to envelop the pipe section, as shown in FIG. 12A.

The compression spring 130 is attached to a spring block 131. The spring block 131 is pinned to the shuttle arm 104 and may tilt relative to it about a bolt 133. This range of movement allows the pad 126 to react to forces imparted by the pipe section 200.

With reference to FIG. 10, an embodiment of the shuttle arm 104 is shown. The shuttle arm 104 has a column stop assembly 150 comprising one stop 152 for each column 106 (FIG. 3). The stops 152 are disposed along the side wall 120. A column stop actuator (not shown) is provided on the drill frame. A stop bar is disposed on the rod end of the actuator. The actuator is configured to move the stop bar along a vertical axis so that the stop bar may intersect a selected stop 152. Each stop 152 corresponds to a matching column 106 when it intersects the stop bar and aids in location of the cradle 110 beneath the proper pipe column. A back stop 154 may be utilized to indicate that the shuttle is aligned with the spindle. Alternatively, a spring or cushioned stop 154 may be utilized to reduce jolting on the shuttle arm 104 when a pipe section is within the cradle 110.

Figure 11:
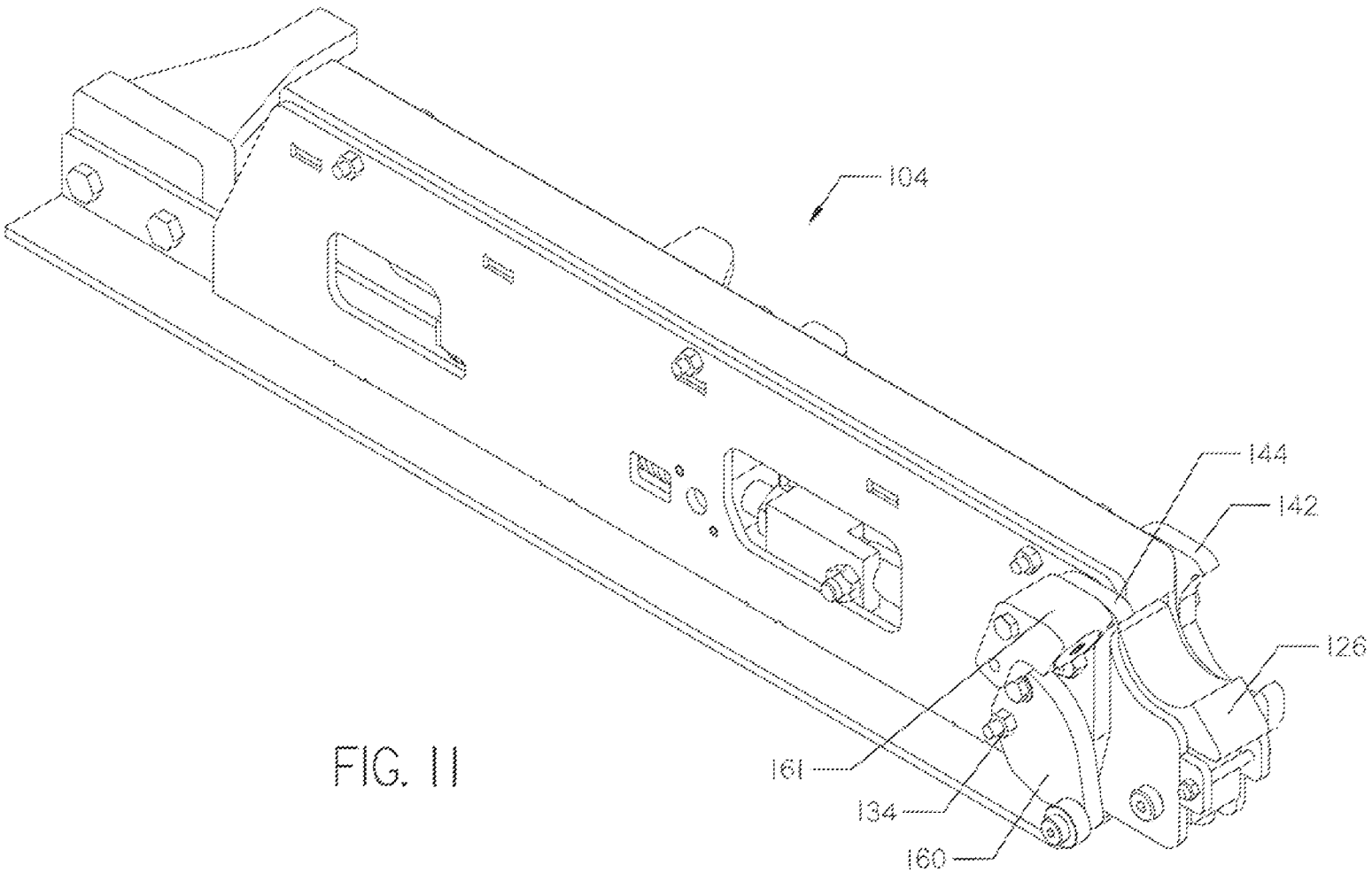
FIG. 11 is a top left perspective view of the shuttle arm of FIG. 10.

In FIGS. 10-11, the cradle 110 comprises a magnet 161 located near the second gripper 144 which may provide a magnetic grip on a pipe section 200. The magnet 161, used in conjunction with grippers 128, the concave surface of pad 126, and lower tong 148 provide for coaxial alignment of a pipe section 200 and the spindle 34.

In the embodiment of FIGS. 10-11, the grippers 128 may be attached to extension plates 160. The extension plates are then attached to rollers 116 to aid in the spacing of the grippers 128. As shown in FIG. 10, the first gripper 142 has both upper 146 and lower 148 ends.

Figure 12B:
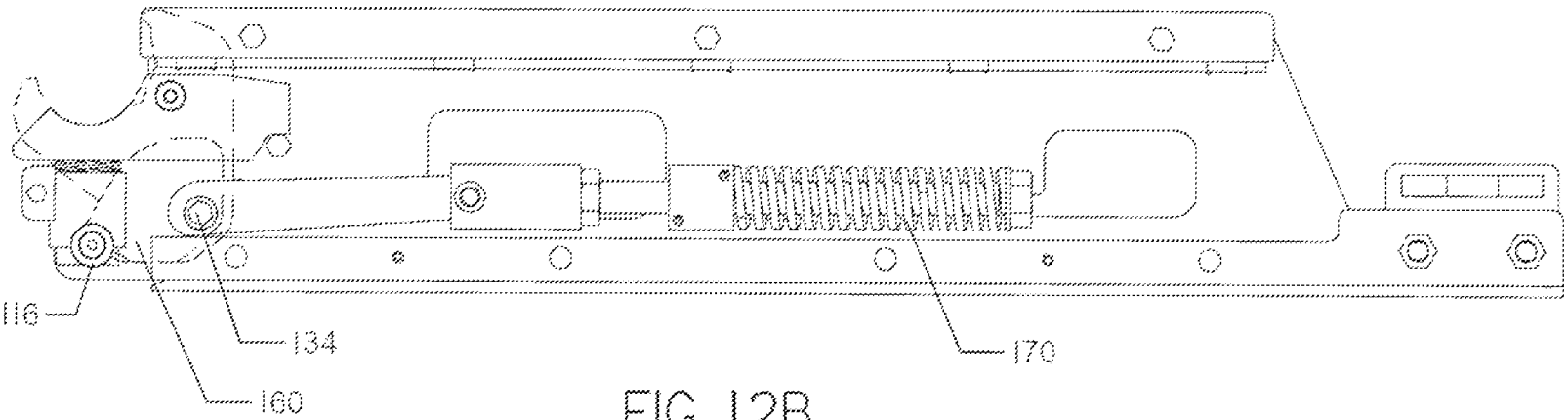
FIG. 12B is the view of FIG. 12A with the cradle shown in the open position.

With reference to FIGS. 12A-12B, the shuttle arm 104 utilizes a compression spring 170 rather than the extension spring 132 to bias the grippers 128 to the closed position. Because the bushing 134 is not co-axial with the roller 116 (as in FIGS. 3-9B), the grippers 128 are closed when the bushing 134 is at a furthest back position relative to the slot 140, as shown in FIG. 12A. When the rollers 116 engage the guide plate 114, the bushing is moved forward in the slot 140, overcoming the bias of the compression spring 170, as shown in FIG. 12B.

Changes may be made in the construction, operation and arrangement of the various parts, elements, steps and procedures described herein without departing from the spirit and scope of the invention as described in the following claims.

The invention claimed is:

1. A drilling machine comprising:
a frame;
a pipe box;
a carriage configured to move along the frame;
a pipe shuttle, comprising:
a shuttle path extending from proximate the pipe box to proximate the carriage;
a body constrained to move along the shuttle path, the body having a curved cam surface formed therein;
a gripper rotatably supported by the shuttle body; and
a bushing disposed against the cam surface, configured to cause rotation of the gripper in response to motion of the body.

2. The drilling machine of claim 1 in which the cam surface comprises an edge of a slot formed in the body.

3. The drilling machine of claim 1 in which the pipe shuttle further comprises a magnet disposed proximate the gripper.

4. The drilling machine of claim 1 in which the body comprises a plurality of locating stops, wherein:
each of the plurality of locating stops corresponds to a position on the pipe box.

5. The drilling machine of claim 1 in which the shuttle path comprises a guide plate, in which the guide plate is engageable with the gripper such that:
the bushing is in a first position relative to the cam surface when the guide plate is engaged with the gripper; and
the bushing is in a second position relative to the cam surface when the guide plate is not engaged with the gripper.

6. The drilling machine of claim 5 in which the guide plate does not engage the gripper on a portion of the shuttle path.

7. The drilling machine of claim 5 wherein the gripper comprises a roller, wherein the roller is configured to engage the guide plate when the bushing is in the first position.

8. The drilling machine of claim 5 in which the pipe shuttle further comprises a cradle, wherein the gripper overhangs the cradle when the bushing is in the second position.

9. The drilling machine of claim 1 in which the body is movable along the shuttle path in a first linear direction and an opposed second linear direction, in which the gripper is rotatable in a first rotational direction and an opposed second rotational direction, in which gripper rotates in the first rotational direction only when the body moves along the shuttle path in the first linear direction, and in which gripper rotates in the second rotational direction only when the body moves along the shuttle path in the second linear direction.

10. A method comprising:
providing the drilling machine of claim 9;
moving the body in the first linear direction;
placing a pipe into a cradle at an end of the body;
with the pipe in the cradle, moving the body in a second linear direction, thereby causing the gripper to rotate in the second rotational direction;
adding the pipe to a drill string;
with the pipe added to the drill string, moving the body in the first linear direction, thereby causing the gripper to rotate in the first rotational direction.

11. A drilling machine comprising:
a frame;
a carriage supported by the frame;
a pipe box comprising a plurality of columns, the pipe box configured to store pipe sections within each of the plurality of columns; and
a pipe shuttle comprising:
a cradle having an upwardly-facing concave surface;
a gripper pivotal relative to the cradle and movable from a first position to a second position, wherein the gripper is configured to contact a pipe being held in the upwardly-facing concave surface when in the first position; and
a body supporting the cradle and the gripper; and
a guide plate along which the pipe shuttle is translated;
in which the guide plate engages a roller carried by the gripper along a portion of its range of translation and engagement with the guide plate moves the gripper from the first position to the second position.

12. The drilling machine of claim 11 in which the guide plate is characterized as a first plate and the gripper is characterized as a first gripper and further comprising:

a second plate along which the frame is translated, the second guide plate situated on an opposite side of the frame from the first guide plate; and a second gripper movable from a first position to a second position, wherein the second gripper is configured to contact a pipe being held in the upwardly-facing concave surface when in the first position;

in which the second plate engages the second gripper along a portion of its range of translation and engagement with the second plate moves the second gripper from the first position to the second position.

13. The drilling machine of claim 12 in which the cradle is disposed between the first gripper and the second gripper.

14. The drilling machine of claim 11 further comprising a magnet supported proximate the cradle.

15. The drilling machine of claim 11 further comprising a cradle spring, in which the cradle spring extends between the body and the cradle.

16. The drilling machine of claim 15 further comprising a spring block, in which the spring block is pivotal relative to the body and supports the cradle spring.

17. The drilling machine of claim 11 in which the gripper is biased to grip a pipe when the gripper is in the first position.

18. The drilling machine of claim 11 wherein the body defines a curved slot, the drilling machine further comprising:

a bushing attached to the gripper, wherein the bushing is carried within the curved slot.

19. The drilling machine of claim 11 in which the gripper comprises an upwardly-facing concave surface disposed adjacent to the upwardly-facing concave surface of the cradle.

20. A method comprising:

placing a shuttle beneath a column of a pipe box, the shuttle comprising an upwardly-facing concave surface and a gripper, wherein the gripper is in a first position when the upwardly-facing concave surface is beneath the pipe box;

placing a pipe into the upwardly-facing concave surface;

translating the shuttle in a first linear direction, whereby translation of the shuttle in the first linear direction causes a first rotational movement of the gripper such that the gripper moves into a second position in which the gripper contacts the pipe;

stopping translation of the shuttle when the pipe is coaxial with a spindle;

connecting the pipe to the spindle; and translating the shuttle in a second linear direction while the pipe is connected to the spindle, whereby translation of the shuttle in the second linear direction causes a second rotational movement of the gripper such that the gripper moves into the first position.

* * * * *